US005493099A

United States Patent [19]

McWilliams, III

[11] Patent Number: 5,493,099

[45] Date of Patent: Feb. 20, 1996

[54] COOKING APPARATUS, LATCHING CONSTRUCTION THEREFOR AND METHODS OF MAKING THE SAME

[75] Inventor: William H. McWilliams, III, Uniontown, Pa.

[73] Assignee: Robertshaw Controls Company, Richmond, Va.

[21] Appl. No.: 365,572

[22] Filed: Dec. 28, 1994

[51] Int. Cl.[6] ..... F24C 7/08; HO5B 1/02

[52] U.S. Cl. ..... 219/413; 219/724; 292/140; 292/124; 292/DIG. 69; 126/197

[58] Field of Search ..... 219/413, 724, 219/722, 723, 412; 292/140, 182, DIG. 69, 123, 124; 126/192, 197

[56] References Cited

U.S. PATENT DOCUMENTS

| | | | |
|---|---|---|---|
| 3,784,776 | 1/1974 | Asanuma | 219/724 |
| 3,805,528 | 4/1974 | Huebscher | 60/530 |
| 4,095,427 | 6/1978 | Stropkay | 60/530 |
| 4,887,429 | 12/1989 | Birli, Sr. et al. | 60/527 |
| 4,901,474 | 2/1990 | Bayard et al. | 292/144 |
| 4,927,996 | 5/1990 | Genbauffe et al. | 219/413 |
| 4,935,989 | 6/1990 | Miller | 16/66 |
| 4,951,693 | 8/1990 | Archambault | 292/DIG. 69 |
| 5,293,666 | 3/1994 | Armstrong | 16/66 |

OTHER PUBLICATIONS

Copending patent application, Serial No. 250,006 filed May 27, 1994.

Copending patent application, Serial No. 229,378 filed Apr. 18, 1994.

*Primary Examiner*—Philip H. Leung

*Attorney, Agent, or Firm*—Fulbright & Jaworski

[57] ABSTRACT

A cooking apparatus, a latching construction therefor and methods of making the same are provided, the latching construction comprising a frame carrying a movable latch member and a drive unit operatively interconnected to the latch member to move the latch member between the latching and unlatching positions thereof, the drive unit comprising a cylinder having opposite ends and a movable piston extending from one of the opposite ends and being operatively interconnected to the latch member, the drive unit having an actuator to extend the piston so as to be adapted to move the latch member from its non-latching position thereof to its latching position thereof when the actuator is first actuated for a door locking operation thereof, the drive unit having a rotatable cam operatively interconnected to the piston and to the latch member so as to be adapted to permit the piston to be retracted after the latch member has been moved to the latching position thereof by the first actuation of the actuating unit while maintaining the latch member in its latching position until the actuating means is again actuated, the cam being adapted to be rotated in only one rotatable direction thereof by the piston.

20 Claims, 10 Drawing Sheets

COOKING APPARATUS, LATCHING CONSTRUCTION THEREFOR AND METHODS OF MAKING THE SAME

BACKGROUND OF THE INVENTION

1. Field of the Invention

This invention relates to a new cooking apparatus and to a new door latching construction for such a cooking apparatus as well as to a new method of making such a cooking apparatus and to a new method of making such a door latching construction.

2. Prior Art Statement

It is known to provide a cooking apparatus comprising a frame means, a cooking chamber means carried by the frame means, heating means carried by the frame means and being adapted to be actuated to heat clean the chamber means, switch means for permitting the heating means to heat clean the chamber means only when the switch means is actuated, a movable door means carried by the frame means for opening and closing the cooking chamber means, a movable latch member carried by the frame means and being movable between a non-latching position thereof that permits the door means to be opened and closed and a latching position thereof that locks the door means in a closed position and actuates the switch means if the door means is in a closed position at the time the latch member is moved to the latching position thereof, and drive means carried by the frame means and having moving means operatively interconnected to the latch member to move the latch member between the positions thereof only when the moving means of the drive means moves from a first position thereof to a second position thereof, the drive means comprising a cylinder means having opposite ends and a movable piston means extending from one of the opposite ends and comprising the moving means operatively interconnected to the latch member, the drive means having actuating means to extend the piston means so as to be adapted to move the latch member from its non-latching position thereof to its latching position thereof when the actuating means is actuated for a door locking operation thereof, the drive means comprising a cam means movably mounted to the frame means and having interconnecting means operatively interconnected to the piston means and to the latch member in a manner to permit the piston means to be retracted after the latch member has been moved to the latching position thereof by the first actuation of the actuating means while maintaining the latch member in its latching position until the actuating means is again actuated. For example see the copending patent application Ser. No. 250,006, of David D. Martin filed May 27, 1994.

It is also known to provide a cooking apparatus comprising a frame means, a cooking chamber means carried by the frame means, heating means carried by the frame means and being adapted to be actuated to heat clean the chamber means, switch means for permitting the heating means to heat clean the chamber means only when the switch means is actuated, a movable door means carried by the frame means for opening and closing the cooking chamber means, a movable latch member carried by the frame means and being movable between a non-latching position thereof that permits the door means to be opened and closed and a latching position thereof that locks the door means in a closed position and actuates the switch means if the door means is in a closed position at the time the latch member is moved to the latching position thereof, and drive means carried by the frame means and having moving means operatively interconnected to the latch member to move the latch member between the positions thereof only when the moving means of the drive means moves from a first position thereof to a second position thereof, the drive means comprising a cylinder means having opposite ends and a movable piston means extending from one of the opposite ends and comprising the moving means operatively interconnected to the latch member, the drive means having actuating means to extend the piston means so as to be adapted to move the latch member from its non-latching position thereof to its latching position thereof when the actuating means is actuated for a door locking operation thereof. For example, see the copending patent application Ser. No. 229,378, filed Apr. 18, 1994 of Thomas M. Martin, David D. Martin, and Eric V. Russ.

It is also known to provide an electro-thermal drive means wherein the same comprises a cylinder means having opposite ends and a movable piston means extending from one of the opposite ends thereof, the drive means having a compression spring means tending to retract the piston means from its extended condition whenever the actuating means of the drive means is actuated to extend the piston means to an extended position thereof and is then deactuated. For Example, see the U.S. Pat. No. 3,805,528 to Huebscher; the U.S. Pat. No. 4,095,427 to Stropkay and the U.S. Pat. No. 4,887,429 to Birli, Sr. et. al.

Also see the U.S. Pat. No. 4,927,996 to Genbauffe et. al. for a latching construction of a cooking apparatus wherein the latch member is moved by a drive means that comprises an electrical motor.

SUMMARY OF THE INVENTION

It is one of the features of this invention to provide a new drive means for uniquely operating the movable latch member of a door latching construction of a cooking apparatus or the like.

In particular, while it was found according to the teachings of the invention set forth in the aforementioned copending U.S. patent application Ser. No. 229,378, filed Apr. 18, 1994, that a piston and cylinder type of drive means can be uniquely arranged to operate the movable latch member of the latching construction so as to provide a relatively inexpensive drive means in contrast to the expensive electrical motor means previously utilized, the actuating means of such a piston and cylinder type of drive means is required to be continuously actuated to hold the latch member in its door locking position or some structure is required to maintain the piston means of the drive means in its extended condition in order to maintain the latch member in its door locking position until it was desired to unlock the oven door.

However, it was found according to the teachings of the invention set forth in the aforementioned copending patent application Ser. No. 250,006, filed May 27, 1994, that such a drive means can be provided with a unique cam means that is adapted to permit the piston means of the drive means to be retracted after the latch member has been moved to the latching position thereof by an initial actuation of the actuating means while maintaining the latch member in its latching position until the actuating means of the drive means is again actuated. Thus, it can be seen that the actuating means of the drive means of that invention need not be in a continuously actuated condition thereof in order to maintain the latch member in its locking position nor does the piston means of such drive means need to be maintained in its extended condition during the entire time that the door latching member is in its door latching position.

It is a feature of this invention to provide a unique rotatable cam means for such a drive means and arranging such cam means and the piston means so that the cam means is only rotated in one rotatable direction thereof by the piston means.

For example, one embodiment of this invention comprises a cooking apparatus comprising a frame means, a cooking chamber means carried by the frame means, heating means carried by the frame means and being adapted to be actuated to heat clean the chamber means, switch means for permitting the heating means to heat clean the chamber means only when the switch means is actuated, a movable door means carried by the frame means for opening and closing the cooking chamber means, a movable latch member carried by the frame means and being movable between a non-latching position thereof that permits the door means to be opened and closed and a latching position thereof that locks the door means in its closed position and actuates the switch means if the door means is in its closed position at the time the latch member is moved to the latching position thereof, and drive means carried by the frame means and having moving means operatively interconnected to the latch member to move the latch member between the positions thereof only when the moving means of the drive means moves from a first position thereof to a second position thereof, the drive means comprising a cylinder means having opposite ends and a movable piston means extending from one of the opposite ends and comprising the moving means operatively interconnected to the latch member, the drive means having actuating means to extend the piston means to be adapted to move the latch member from its non-latching position thereof to its latching position thereof when the actuating means is first actuated for a door locking operation thereof, the drive means comprising a cam means movably mounted to the frame means and having interconnecting means operatively interconnected to the piston means and to the latch member in a manner to permit the piston means to be retracted after the latch member has been moved to the latching position thereof by the first actuation of the actuating means while maintaining the latch member in its latching position until the actuating means is again actuated, the cam means comprising a cam rotatably mounted to the frame means and being operatively interconnected to the piston means by the interconnecting means thereof so as to be rotated in only one rotatable direction thereby.

Accordingly, it is an object of this invention to provide a new cooking apparatus having one or more of the novel features of this invention as set forth above or hereinafter shown or described.

Another object of this invention is to provide a new method of making such a cooking apparatus, the method of this invention having one or more of the novel features of this invention as set forth above or hereinafter shown or described.

Another object of this invention is to provide a new latching construction for a cooking apparatus, the latching construction of this invention having one or more of the novel features of this invention as set forth above or hereinafter shown or described.

Another object of this invention is to provide a new method of making such a latching construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
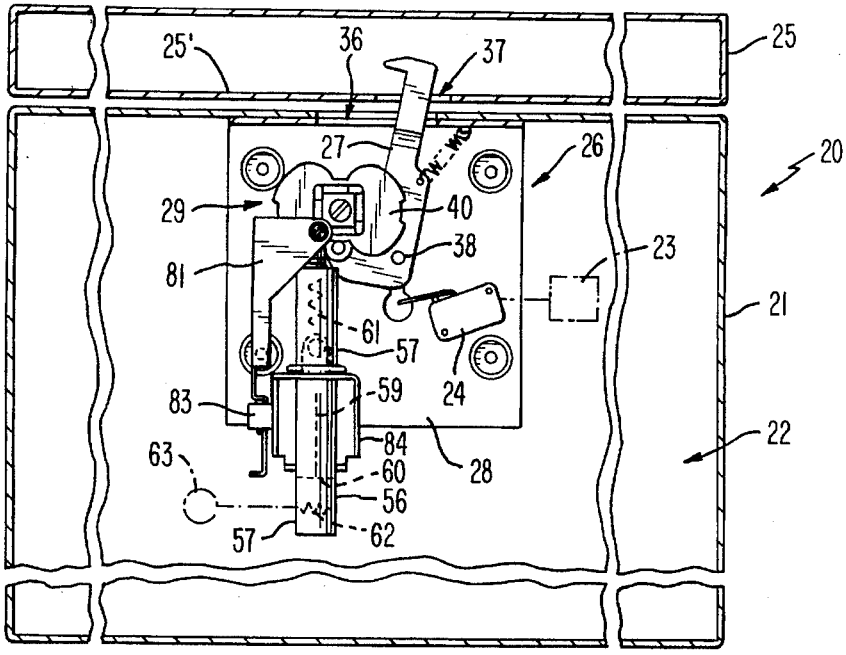
FIG. 1 is a schematic cross-sectional view illustrating the new cooking apparatus of this invention utilizing the new door latching construction of this invention, the door means of the cooking apparatus being in its closed position and the latch member of the latching construction being in its non-latching position.

While the various features of this invention are hereinafter illustrated and described as being particularly adapted to provide a door latching construction for a particular cooking apparatus, it is to be understood that the various features of this invention can be utilized singly or in various combinations thereof to provide a door latching construction for other types of cooking apparatus as desired.

Therefore, this invention is not to be limited to only the embodiments illustrated in the drawings, because the drawings are merely utilized to illustrate one of the wide variety of uses of this invention.

Referring now to FIG. 1, a new cooking apparatus of this invention is generally indicated by the reference numeral 20 and comprises a frame means 21 carrying a cooking chamber means 22 and a heating means 23 that is adapted to be actuated to heat clean the chamber means 22 in a manner well known in the art. An electrical switch means 24 is carried by the frame means 21 in a manner hereinafter set forth and permits the heating means 23 to heat clean the chamber means 22 only when the switch means 24 is actuated to a certain condition thereof.

Figure 10:
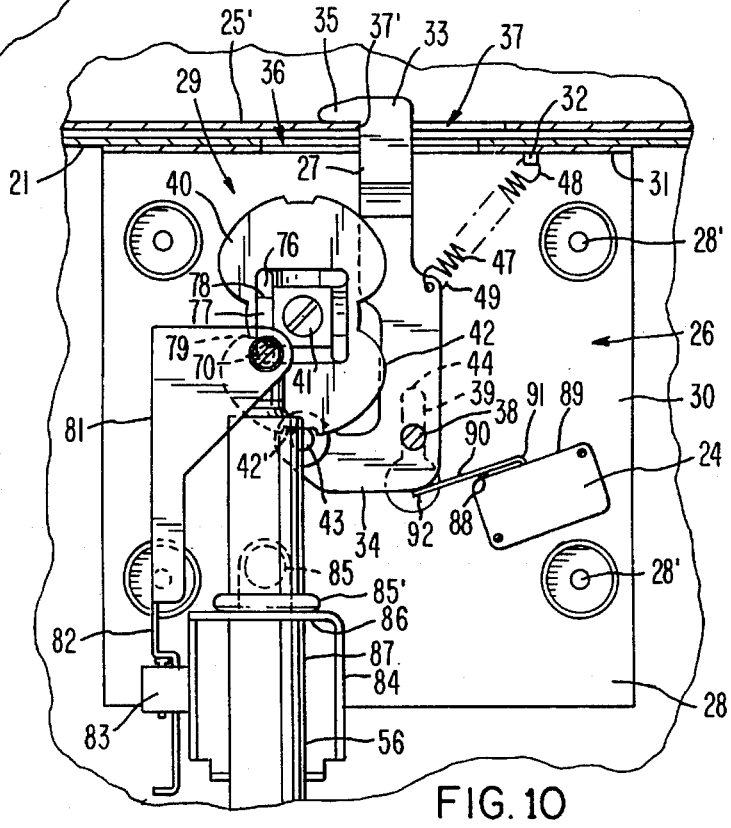
FIG. 10 is a view similar to FIG. 7 and illustrates the drive means after the piston means thereof has been fully retracted and while maintaining the latch member in its door locking position.
Figure 11:
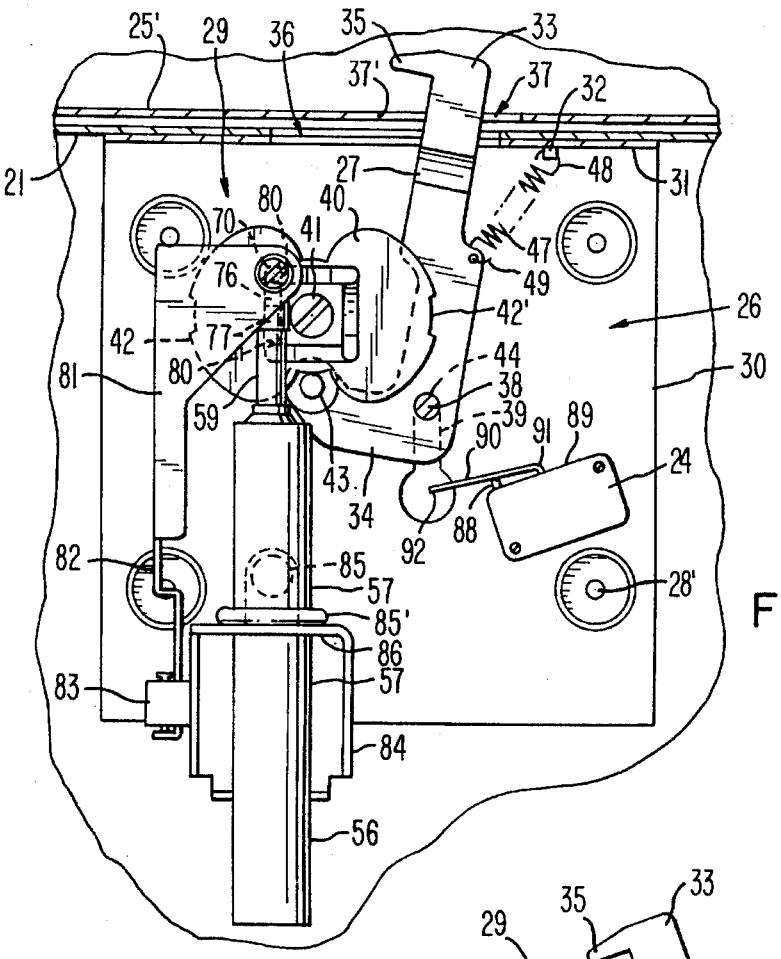
FIG. 11 is a view similar to FIG. 10 and illustrates the latch member having been moved from its door locking position of FIG. 10 to its unlatching position of FIG. 2 by the drive means being again actuated to extend its piston means so as to so move the latch member from its latching position to its non-latching position.
Figure 12:
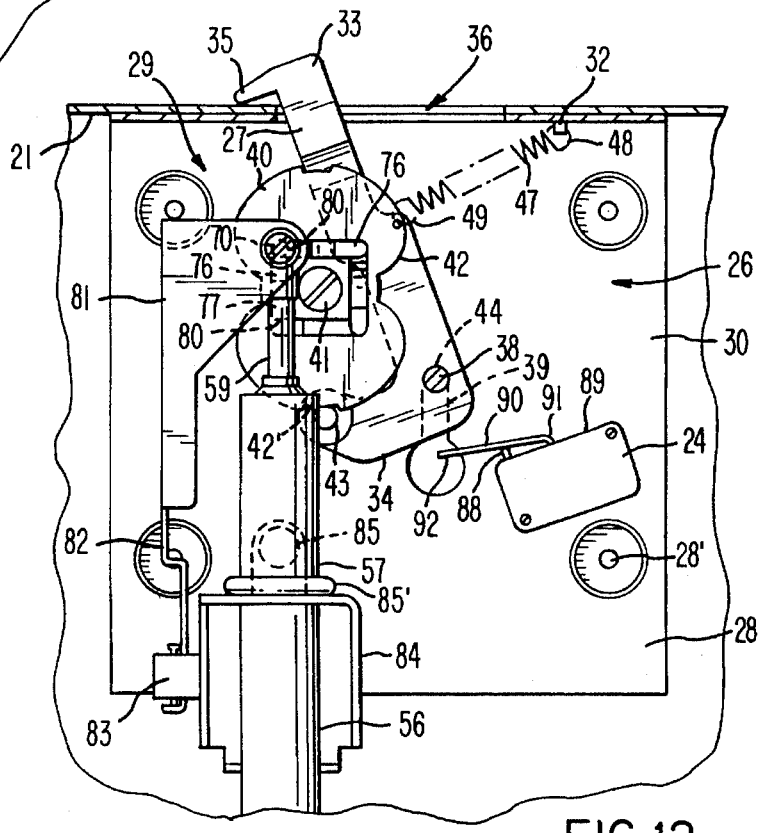
FIG. 12 is a view similar to FIG. 2 and illustrates the latching member having been moved to a third position thereof when the oven door means is in an open position and the drive means for the latch member tends to move the latch member from its non-latching position to its latching position.

The cooking apparatus 20 has movable door means 25 that is movably carried by the frame means 21 in a conventional manner for opening and closing the cooking chamber means 22, the door means 25 being shown in the closed condition in FIGS. 1, 2, 3, 5, 6, 7, 8, 9, 10 and 11 and in its open condition in FIG. 12.

Figure 2:
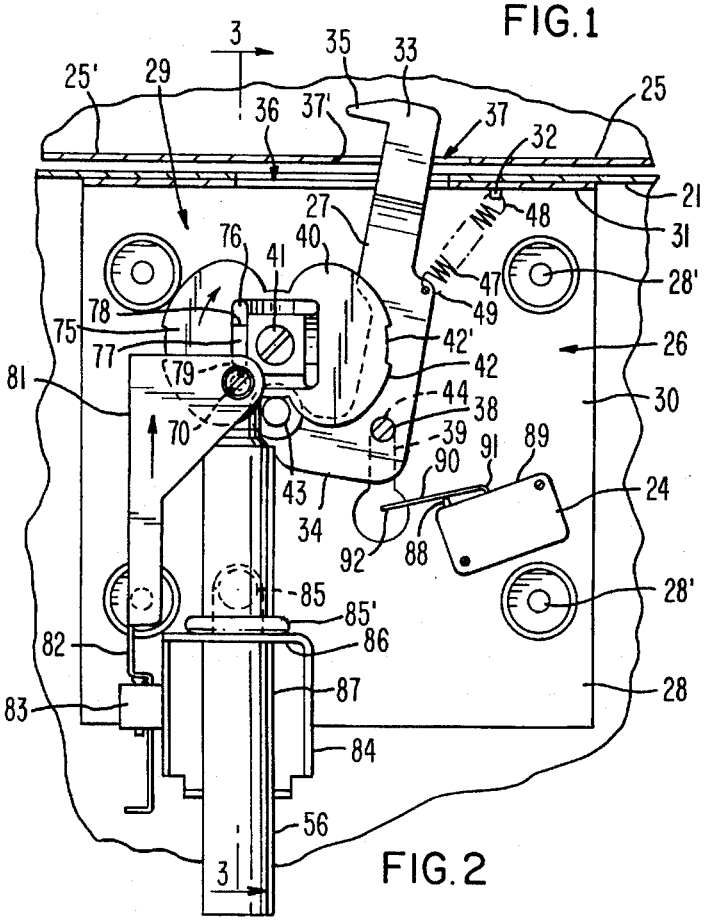
FIG. 2 is an enlarged fragmentary view of the latching structure of FIG. 1.

A new door latching construction of this invention is generally indicated by the reference numeral 26 and is carried by the frame means 21 of the cooking apparatus 20 in a manner hereinafter set forth, the latching construction 26 comprising a movable latch member 27 carried by a frame means 28 that forms part of the main frame means 21 and bolted or screwed thereto in the manner illustrated by the reference numerals 28' in FIG. 2 to position the frame means 28 as illustrated in FIG. 2.

Figure 6:
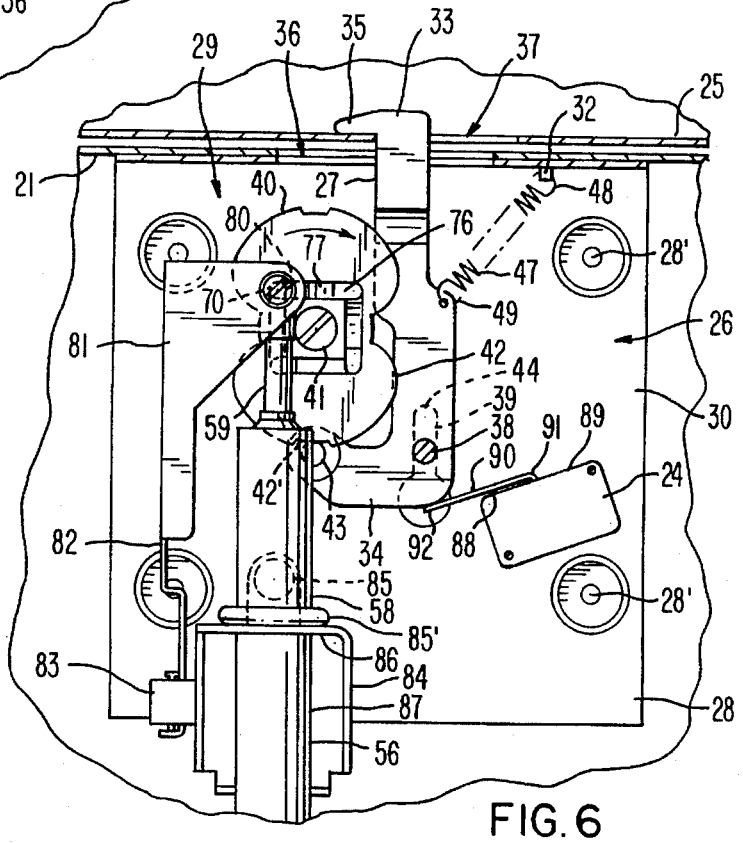
FIG. 6 is a view similar to FIG. 5 and illustrates the latching member having been moved to its door latching position by the drive means of the latching construction of FIG. 1.
Figure 7:
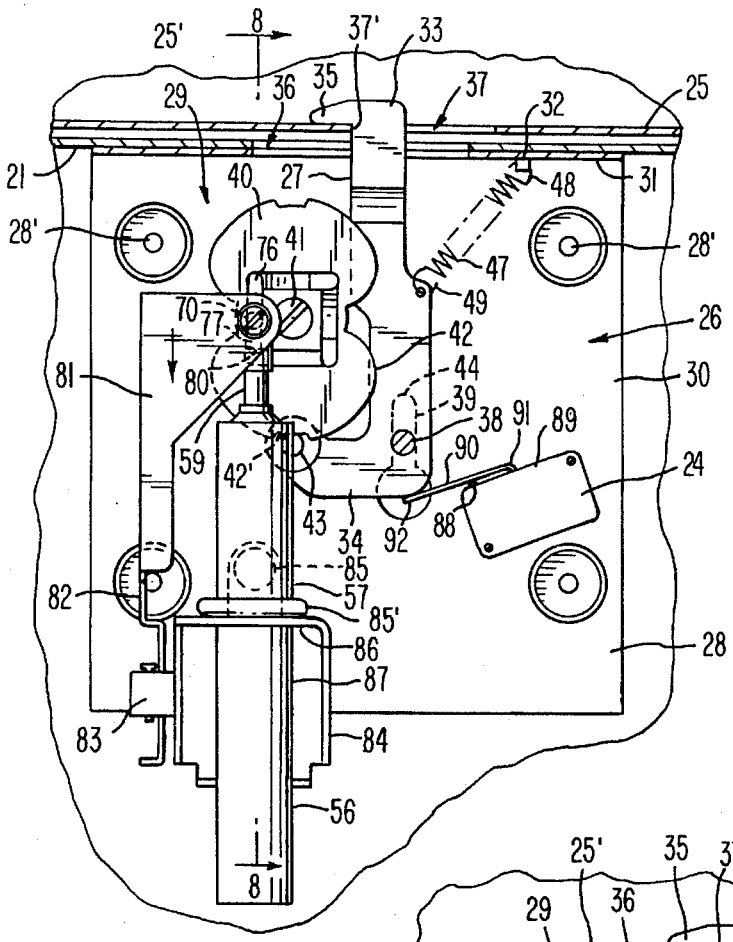
FIG. 7 is a view similar to FIG. 6 and illustrates the latch member in its door latching position of FIG. 7 and the drive means being moved toward its retracted position.

The latch member 27 is operatively interconnected to a drive means of this invention that is generally indicated by the reference numeral 29 in the drawings, the latch member 27 being movable between a non-latching position thereof as illustrated in FIG. 2 that permits the door means 25 to be opened and closed as desired and a latching position thereof as illustrated in FIGS. 6, 7 and 10 that locks the door means 25 in its closed condition if, at the time the latch member is moved to the latching position thereof by the drive means 29, the door means 25 is in its closed condition as will be apparent hereinafter. However, the latch member 27 is moved from its non-latching position directly to a third position thereof as illustrated in FIG. 12 by the drive means 29 when the drive means 29 tends move the latch member 27 to the latching position thereof when the door means 25 is not in a closed condition thereof as will be apparent hereinafter.

The latch member 27 and the electrical switch means 24 are so disposed on the frame means 28 of the cooking apparatus 20 that the switch means 24 is only actuated by the latch member 27 when the latch member 27 is moved to its latching position as illustrated in FIGS. 5, 6, 7 and 10 and is not actuated when the latch member 27 is moved to its third position as illustrated in FIG. 12 as will also be apparent hereinafter.

Thus, it can be seen that the general operation of the latching construction 26 previously described is fully set forth in the aforementioned U.S. Pat. No. 4,927,996 to Genbauffe et. al., whereby this U.S. patent is being incorporated into this disclosure by this reference thereto.

Such general operation of the latching construction 26 is also fully set forth in the aforementioned copending patent application Ser. Nos. 229,378, filed Apr. 18, 1994, and Serial No. 250,006, filed May 27, 1994.

The frame means 28 of the latching construction 26 comprises a plate 30 formed of any suitable material, such as metallic material, and having a turned end 31 that is provided with an integral tang 32 for a purpose hereinafter set forth.

The latch member 27 comprises a one-piece member formed of any suitable material, such as metallic material, and having opposed ends 33 and 34, the end 33 having a hook 35 and being adapted to project out of an opening means 36 cooperatively formed through the frame means 28, 21 so as to be received through an opening means 37 formed in the side of the door means 25 as illustrated in FIG. 2 when the door means 25 is in its closed condition thereof and the latch member 27 is in the non-latching position thereof.

The end 34 of the latch member 27 has a pivot pin 38 extending outwardly therefrom and received in an elongated slot means 39 passing through the plate 30 whereby the latch member 27 is pivotally mounted to the plate 30 by the pivot pin 38 and is movable upwardly and downwardly relative to the plate 30 as illustrated in FIG. 2 as the pivot pin 38 is slidable in the slot means 39 as will be apparent.

A unique cam 40 of the drive means 29 of this invention is rotatably mounted to the plate 30 by a shaft means 41 and has an outer peripheral cam surface 42 that acts against a non-rotatable cylindrical post or cam follower 43 carried on the end 34 of the latch member 27 to control the position of the latch member 27 relative to the plate 30 as will also be apparent hereinafter.

A tension spring 47 has one end 48 hooked to the tang 32 of the plate 30 and the other end 49 fastened to the latch member 27 in such a position that the force of the tension spring 47 normally tends to maintain the latch member 27 in the non-latching position illustrated in FIG. 2 where the pivot pin 38 is at an end 44 of the slot means 39.

The drive means 29 comprises a piston and cylinder unit 56 which comprises a tubular cylinder member 57 and a piston means 58, the piston means 58 comprising a piston rod 59 interconnected to a piston 60 disposed in the cylinder member 57 and normally being urged to a position wherein the piston means 58 is in its fully retracted condition by an internal compression spring means 61, FIG. 1, also disposed in the cylinder member 57.

The piston and cylinder means 56 includes an actuator 62 disposed in the cylinder member 57 and when interconnected to an electrical power source 63, the actuator 62 is actuated and causes the piston means 58 to move to an extended condition relative to the cylinder member 57 in opposition to the force of the compression spring means 61 for a purpose hereinafter set forth, the actuating means 62 comprising an electrical heater means which causes an expansion of a fluid means (not shown) disposed in the cylinder member 57 when the heater means 62 is energized by the source 63 to drive the piston 60 upwardly in FIG. 1 to extend the piston rod 59 from the retracted condition illustrated in FIG. 2 to the extended condition illustrated in FIG. 6 for a purpose hereinafter described. However, when the electrical power source is disconnected from the actuator means 62, the actuator means 62 is deactuated and the spring means 61 is adapted to return the piston means 58 to its retracted condition as illustrated in FIG. 2 as will be apparent hereinafter.

Since the operation and structure of the piston and cylinder unit 56 is well known in the art, the spring means 61, the actuator means 62, the piston 60 and the piston rod 59 have been schematically illustrated in FIG. 1 of the drawings and need not be further described. For example, see the piston and cylinder units known as electrothermal means as set forth in the aforementioned U.S. Pat. No. 3,805,528 to Huebscher; the U.S. Pat. No. 4,095,427 to Stropkay, and the U.S. Pat. No. 4,887,429 to Birli, Sr., et. al., whereby these three U.S. patents are being incorporated into this disclosure by this reference thereto.

The piston and cylinder unit 56 has a driver 64 fastened to the piston rod 59 thereof, such as by having an externally threaded end 65 of the piston rod 59 threadedly disposed in a threaded opening 66 of the driver 64.

Figure 3:
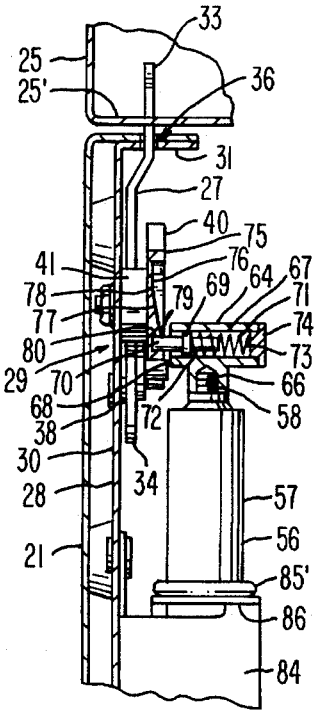
FIG. 3 is a fragmentary cross-sectional view taken on line 3—3 of FIG. 2.

The driver 64 has an opening 67 interrupting an end 68 thereof and receiving a piston 69 therein that has a projection 70 extending out of the open end 68 of the driver 64 to operatively interconnect the piston means 58 to the cam 40 in a manner hereinafter set forth, a compression spring 71 being disposed in the opening 67 of the driver 64 and urging the projection 70 outwardly therefrom as one end 72 of the spring 71 bears against the piston 69 and the other end 73 of the spring 71 bears against a closed end 74 of the opening 67 as illustrated in FIG. 3.

The cam 40 has a flat face or side 75 interrupted by spaced apart four recesses 76 that are disposed in a circular array about the axis of rotation of the cam 40 as illustrated in FIG. 2, each recess 76 having a straight line ramp 77 that begins at an end 78 thereof at the same level as the bottom of its recess 76 and then ramping upwardly to the other end 79 thereof which is higher than the recess 76 adjacent thereto as illustrated in FIG. 3. Thus each end 79 of a ramp 77 defines a shoulder 80 against which the side of the piston 70 will engage in the manner illustrated in FIG. 3.

The driver 74 is also attached to a bracket 81 that has a tail or tang 82 guided through a suitable opening (not shown) in a guide 83 of a mounting bracket 84 that is rotatably mounted to the plate 30 by rivet pin means 85. The cylinder 57 of the actuator 56 is also carried by the bracket 84 and has an enlargement 85' thereof engaging against a part 86 of the bracket 84 while a lower portion 87 of the cylinder 57 passes through a suitable opening (not shown) in the part 86 of the bracket 84.

It will be seen that the unique cam 40 of this invention will rotate 90° for each actuation of the linear actuator 56 which provides a motive force to the cam 40. Each 90° of rotation of the cam 40 provides either a latching or unlatching movement of the latch member 27 depending upon the particular part of the cam surface 42 acting on the post or follower 43 of the latch member 27 at that time. When the actuator 62 of the piston and cylinder means 56 is deactuated, the spring 61 thereof will retract the piston means 58 into its retracted condition and the driver 64 disengages from the particular recess 76 of the cam 40 and is guided by the respective ramp 77 into engagement with the next recess 76 to again rotate that cam 40 another 90° when the actuator 62 of the piston and cylinder member 56 is again actuated as will be apparent hereinafter. Thus, the cam 40 rotates in only one rotatable direction thereof as there is no movement of the cam 40 during the return stroke of the piston means 58.

As illustrated in FIGS. 1 and 2, the electrical switch 24 has an actuator button 88 extending from a housing means 89 thereof and is normally urged outwardly by an internal spring means (not shown) so that as long as the actuator button 88 is in an out condition, the switch means 24 will not permit the heating means 23 of the cooking apparatus 20 to be operated to heat clean the chamber 22. However, when the actuator button 88 is moved inwardly relative to the housing 89, the switch means 24 permits the heating means 23 to be actuated to heat clean the chamber means 22 as long as the actuator button is in its actuated condition.

In particular, a switch arm 90 has one end 91 thereof pivotally mounted to the housing means 89 while the other end 92 of the arm 90 extends beyond the actuator button 88 which bears against a medial portion of the arm 90 whereby the force of the internal spring means acting on the actuator button 88 is adapted to maintain the button 88 outwardly even though the arm 90 is contacting the button 88. However, the end 34 of the latch member 27 is adapted to engage against the end 92 of the arm 90 and move the actuator button 88 to the in actuated position thereof when the latch member 27 is in the latching position as illustrated in FIG. 6 but will not engage against the end 92 of the arm 90 when the latch member 27 is in the position illustrated in FIGS. 2, 5, 11 or 12 so that it is only when the latch member 27 is in the fully latching position thereof as illustrated in FIG. 6 that the switch means 24 will be operated to permit the heating means 23 to heat clean the oven 22 as will be apparent hereinafter.

Therefore, it can be seen that it is a relatively simple method of this invention to make the latching construction 26 of this invention to operate in the cooking apparatus 20 in a manner now to be described.

Figure 4:
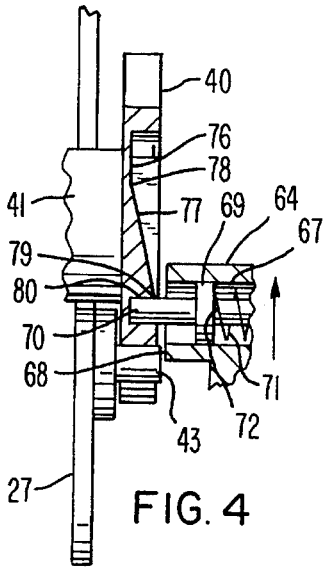
FIG. 4 is an enlarged view of part of the structure of FIG. 3.

Normally, the latch construction 26 is disposed in the condition illustrated in FIGS. 1 and 2 wherein the latch member 27 is in its non-latching position with the piston means 58 having the drive pin 70 of the driver 64 disposed in the lower left recess 76 of the cam 40 so as to be disposed against the shoulder 80 as illustrated in FIGS. 3 and 4 with the piston means 58 being in its fully retracted condition.

Figure 5:
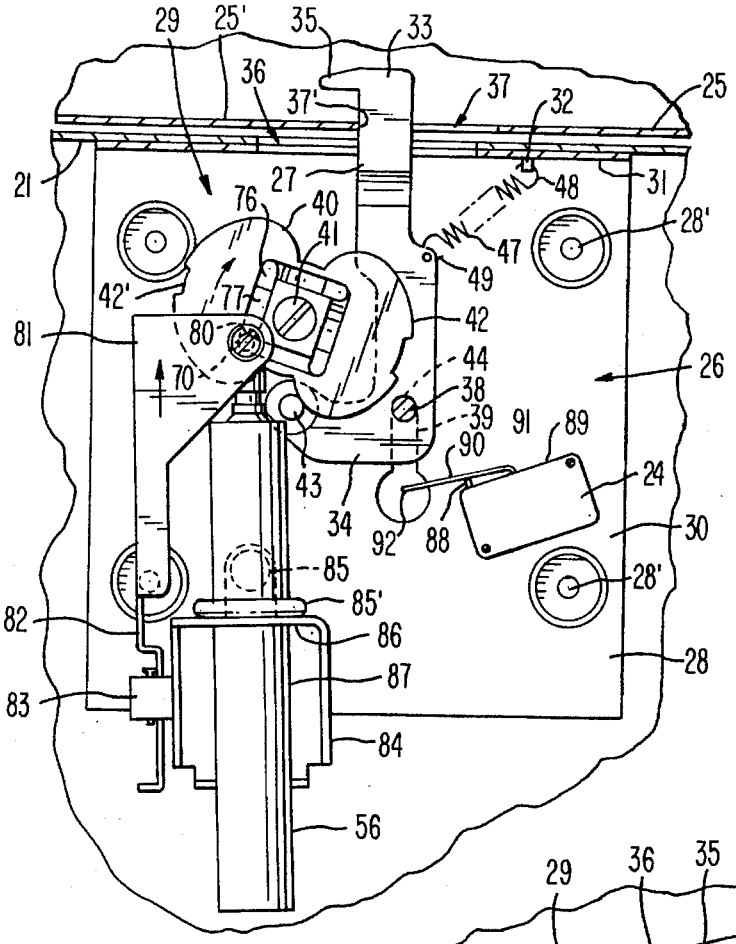
FIG. 5 is a view similar to FIG. 2 and illustrates the latch member having been moved to a position thereof wherein the same initially makes contact with the closed oven door of the cooking apparatus.

When it is desired to latch oven door 25 in its closed condition as illustrated in FIG. 2, the operator through a suitable switch (not shown) causes the electrical power source 63 to be interconnected to the actuator means 62 of the drive means 29 to cause the piston means 58 to be extended outwardly from the cylinder member 57 in opposition to the force of the spring 61 as illustrated in FIG. 5, such outward movement of the piston means 58 causing the drive cam 40 to begin to rotate in a clockwise direction as illustrated in FIG. 5 as the driver pin 70 is pushing against the shoulder 80 of the left hand ramp means 77. Such clockwise rotation of the drive cam 40 causes the latch member 27 to pivot on its pivot pin 38 at the end 44 of the slot 39 in a counterclockwise direction as the cam surface 42 is acting on the post or cam follower 43 to cause such counterclockwise pivoting movement of the latch member 27 until the same engages against an edge 37' of the oven door 25 defined by the opening 37 thereof so that the latch member 27 can no longer be moved in a counterclockwise direction by the outwardly extending piston means 58 as illustrated in FIG. 5. However, further movement of the piston means 58 in an extended direction thereof continues to cause the drive cam 40 to rotate in a clockwise direction as illustrated in FIG. 6 and the particular part of the cam surface 42 of the cam 40 now acting on the cam follower 43 of the latch member 27 moves the latch member 27 downwardly as the pin 38 of the latch member 27 slides downwardly in the slot 39 of the plate 30 as illustrated in FIG. 6 to cause the hook 35 of the latch member 27 to engage against the side 25' of the oven door 25, to pull the oven door 25 tightly closed and to hold the same in the closed condition as illustrated in FIG. 6. At this time, the piston means 58 is in its fully extended condition so as to not only position the recess 76 in which the drive pin 70 is located axially above another recess 76 as illustrated in FIG. 6 with those recesses 76 being in aligned relation parallel to the axis of the piston means 58, but also a recess 42' in the end of the cam 40 has received the cam follower 43 therein as illustrated in FIG. 6 to prevent movement of the cam 40 during subsequent retraction of the piston means 58 as will be apparent hereinafter. Also, it can be seen in FIG. 6 that when the latch member 27 is moved into its door locking position, the end 34 of the latch member 27 acts on the end 92 of the arm 90 of the switch 24 to move the actuator button 88 to its in actuated condition whereby the switch means 24 now permits the heating means 25 of the cooking apparatus 20 to heat clean the oven 22.

Figure 8:
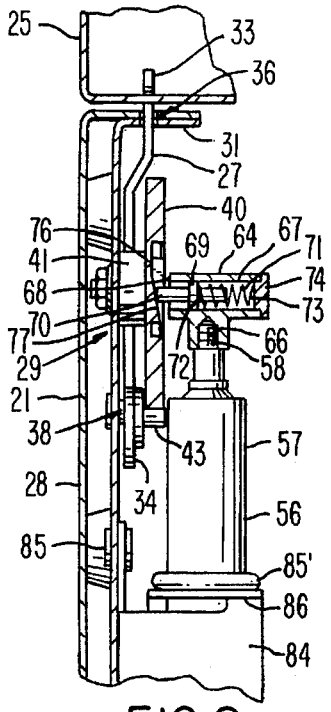
FIG. 8 is a fragmentary cross-sectional view taken on line 8—8 of FIG. 7.
Figure 9:
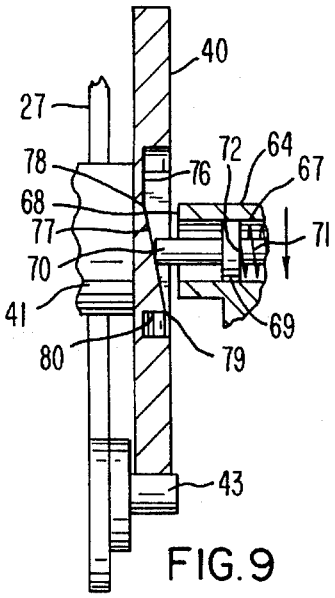
FIG. 9 is an enlarged fragmentary view of part of the structure of FIG. 8.

After the piston means 58 of the drive means 29 has moved to its extended condition as illustrated in FIG. 6, so as to move the latch member 27 to its locking condition as previously set forth, the operator of the control means for the cooking apparatus 20 terminates the flow of electrical current to the actuator means 62 of the drive means 29 so that the internal spring means 61 of the drive means 29 will now move the piston means 58 from its fully extended position back to its fully retracted position and such movement of the piston means 58 causes the pin 70 of the driver 64 to move down the ramp 77 of the cam 40 as illustrated in FIGS. 7, 8 and 9 in opposition to the force of the compression spring 71 thereof until the drive pin 70 snaps into the lower left hand recess 76 of the cam 40 while in the position illustrated in FIG. 10.

Thus, the cam 40 is held in the position illustrated in FIG. 10 by the drive pin 70 being positioned in the lower left hand recess 76 of the cam 40 as illustrated in FIG. 10 and the particular portion of the cam surface 42 of the cam 40 holds the latch member 27 in its oven door latched condition as illustrated in FIG. 10 even though the tension spring 47 is tending to move the latch member 27 upwardly and, thus, move the pivot pin 38 upwardly to the end 44 of the slot 39 in the plate 30 and tend to pivot the latch member 27 in a clockwise direction on the pivot pin 38 thereof.

In this manner, the actuator 62 of the drive means 29 need not be maintained in an actuated condition thereof during the entire time that the oven chamber 22 is being heat cleaned by the heating means 23 and the latch member 27 also remains in its door locked condition during the entire heat cleaning operation.

After the oven chamber 22 has been heat cleaned and the heating means 23 has been turned off by the control means (not shown) of the cooking apparatus 20 so that the temperature of the oven chamber eventually falls below a safe temperature, such as below approximately 600° F., the operator of the control means of the cooking apparatus 20 causes the power source 63 to be again interconnected to the actuator 62 to again cause the piston means 58 to be outwardly extended from its retracted condition as illustrated in FIG. 10 to its fully extended condition as illustrated in FIG. 11 but now the extending piston means 58 causes the cam 40 to further rotate in the clockwise direction from the position illustrated in FIG. 10 to the position illustrated in FIG. 11 so that the cam surface 42 thereof that is now acting on the cam follower 43 of the latch member 27 permits the tension spring 47 to pull the latch member 27 upwardly so that the pivot pin 38 thereof is now at the end 44 of the slot means 39 and to then pivot the latch member 27 in a clockwise direction to its fully unlatched condition as illustrated in FIG. 11. Once the oven door 25 has been unlocked, the flow of electrical current from the source 23 to the actuator 62 of the drive means is terminated so that the internal spring means 61 of the drive means 29 now causes the piston means 58 to be retracted and in this position of the drive means 29, it can be seen that the drive pin 70 moves down the adjacent cam ramp 77 to be again positioned into the lower left recess 76 as illustrated in FIG. 2 so that the drive pin 70 will be in a proper position to thereafter move upwardly and again cause rotation of the cam 40 in a clockwise direction to perform a latching operation in the manner previously described when needed.

However, should the oven door 25 not be in a closed condition when the drive means 29 is actuated to begin a door locking operation, such outward movement of the piston means 58 causes the drive cam 40 to rotate in a clockwise direction and cause the latch member 27 to pivot in a counterclockwise direction through the action of the cam surface 42 on the cam follower 43 in the manner previously described but because the latch member 27 does not hit the edge 37' of the oven door 25, the latch member 27 continues to pivot in the manner illustrated in FIG. 12 and not have the pivot pin 38 thereof leave the upper end 44 of the slot 39 in the plate 30 so that when the piston means 58 is fully extended as illustrated in FIG. 12, it can be seen in FIG. 12 that such condition of the latch member 27 will not cause the end 34 thereof to engage the arm 90 of the switch means 24 to actuate the button 88 thereof. Thus, once the actuator means 62 of the drive means 29 is disconnected from the power source 63, the internal spring means 61 of the drive means 29 will now retract the piston means 58 from the position illustrated in FIG. 12 so that the drive pin 70 now moves down the adjacent ramp 77 of the drive cam 40 so as to be positioned at the lower left hand recess 76 of the cam 40. Thus, upon the next actuation of the actuator means 62, the piston means 58 is again extending from the retracted position of FIG. 12 and causes the cam 40 to rotate in the clockwise direction whereby the part of the cam surface 42 of the cam 40 now acting on the follower 43 permits the latch member 27 to likewise pivot in a clockwise direction and return to the non-latching position thereof as illustrated in FIG. 2 under the force of the tension spring 47 as previously described.

Thus, it can be seen that the drive means 29 only requires the actuator means 62 thereof to be energized to move the latch member 27 to its door locking position and then be de-energized during the entire time that the cooking chamber 22 is being heat cleaned as the drive means 29 will hold the latch member 27 in its door locking position. However, if the oven door 25 is not closed the door latch member 27 will not permit a heat cleaning operation to take place even though the same has been moved from its unlatched position as the switch means 24 will not be operated if the oven door means 25 is not in a closed position at the time the drive means 29 moves the latch member 27 toward its door locking position for the reasons previously set forth.

The above feature of permitting the actuator means 62 of the drive means 29 to be deactuated after the latch member 27 has moved to its latching position so that the piston means 58 can be moved to its fully retracted position is provided by the escapement mechanism of the ramped engagement locations of the recesses 76 and ramps 77 which function in the manner previously set forth.

However, it is to be understood that other escapement mechanisms for the cam 40 and the piston means 58 can be provided if desired.

In particular, it is believed that the cam can have four round holes in the drive surface thereof at the same locations where the recesses 76 were provided in the drive means 29 previously described and the drive pin 70 could be provided with a bevel so as to create disengagement from a particular hole on the return or retracting stroke of the piston means.

In particular, such a cooking apparatus of this invention is generally indicated by the reference numeral 20A in FIGS. 13–17 and the parts thereof that are similar to the parts of the cooking apparatus 20 previously described are indicated by like reference numerals followed by the reference letter "A".

Figure 13:
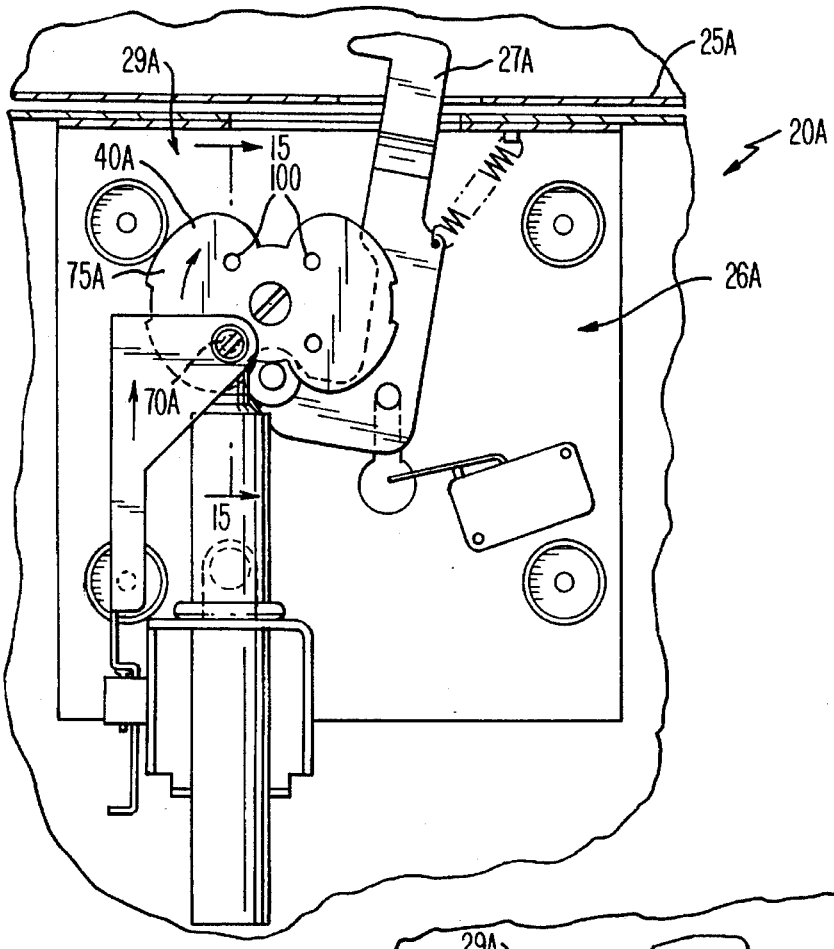
FIG. 13 is a view similar to FIG. 2 and illustrates another cooking apparatus of this invention having another latching construction of this invention, the piston means of the latching construction being illustrated in a partially extended condition thereof.
Figure 14:
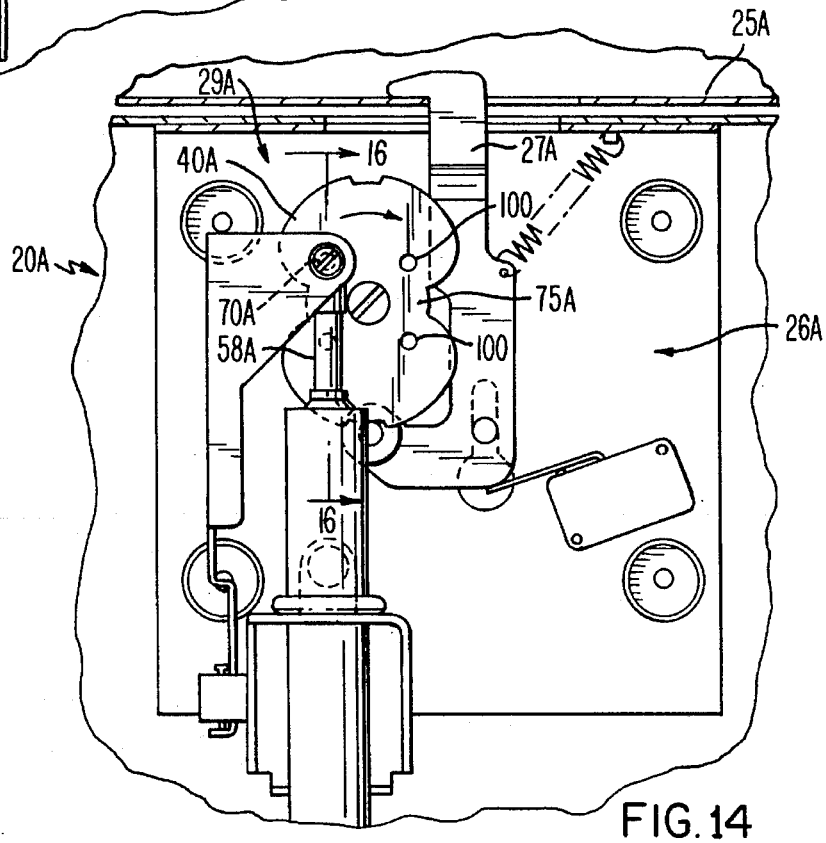
FIG. 14 is a view similar to FIG. 13 and illustrates the latch member having been moved to its door locking position and with the piston means of the drive means in its fully extended position.

As illustrated in FIGS. 13 and 14, it can be seen that the drive means 29A of the latching construction 26A for the cooking apparatus 20A is substantially identical to the drive means 29 of the cooking apparatus 20 previously described except that the flat surface 75A of the cam 40A has four round holes 100 formed therein and being located in the same location as the recesses 76 of the cam 40 previously described whereby the holes 100 are disposed in a circular array thereof about the axis of rotation of the cam 40A.

Figure 15:
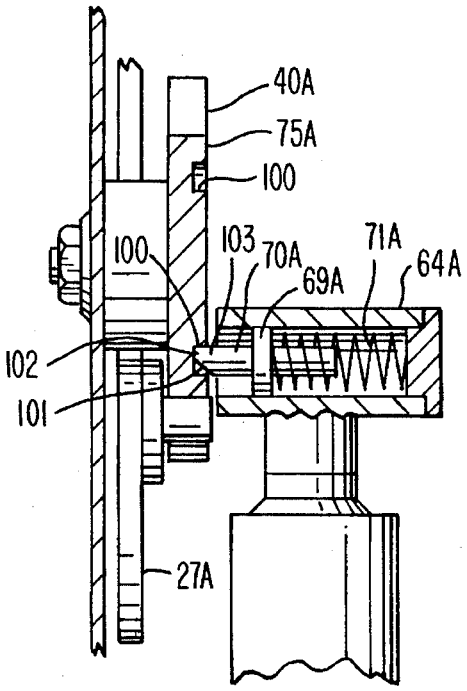
FIG. 15 is an enlarged fragmentary cross-sectional view taken on lines 15—15 of FIG. 13.
Figure 17:
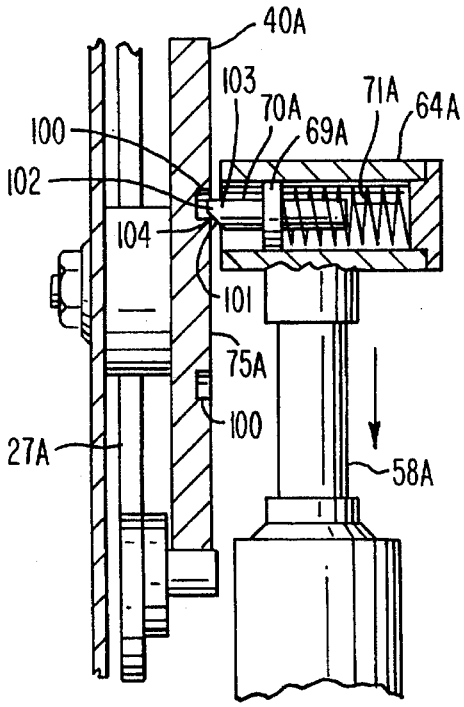
FIG. 17 is an view similar to FIG. 16 and illustrates the piston means as it begins its retraction movement from the fully extended condition of FIG. 16.

In addition, the drive pin 70A of the drive means 64A has a beveled surface 101 at the end 102 thereof which is held in a proper position as illustrated in FIG. 15 by suitable spline means (not shown) formed between the piston 69A and the driver 64A which permits the spring 71A to provide for the axial movement of the drive pin 70A but such spline means prevents rotational movement of the pin 70A relative to the driver 64A so that the beveled surface 101 is always facing downwardly as illustrated in FIGS. 15 and 17.

Figure 16:
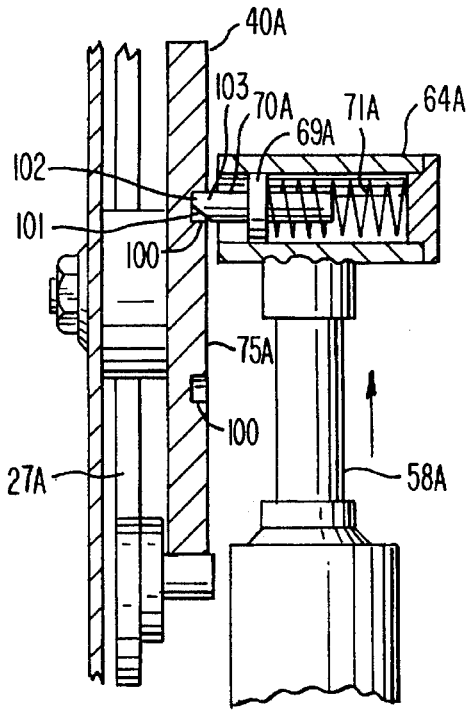
FIG. 16 is a view similar to FIG. 16 and is taken on lines 16—16 of FIG. 14.

In this manner, it can be seen that when the drive means 29A has the piston means 58A thereof in the fully retracted position as illustrated in FIGS. 13 and 15, the drive pin 70A is fully received in the hole 100 which is located in the lower left hand position of the cam 40A whereby the non-beveled part 103 of the pin 70A will drive the cam 40A in a clockwise direction when the piston means 58A is being extended in the manner illustrated in FIGS. 14 and 16 to cause the latch member 27A to lock the oven door 25A in its closed condition in the manner previously set forth. However, when the piston means 58A is permitted to retract from its extended condition of FIG. 14 back to its fully retracted position as illustrated in FIG. 13, the downward movement of the piston means 58A in the manner illustrated in FIG. 17 has the beveled surface 101 acting on the peripheral edge 104 of the upper hole 100 so as to move or cam the pin 70A to the right and thereby be retracted from the upper hole 100 and then be moved downwardly to the lower hole that is located in the lower left hand position as illustrated in FIG. 14 to provide a subsequent driving relation therewith in the manner previously described.

Therefore, it can be seen that the beveled surface 101 on the drive pin 70A provides an escapement means so that the cam 40A will only be rotated in a clockwise direction when viewing the same in FIGS. 13 and 14 by the movement of the piston means 58A on each extending stroke thereof.

Since the operation of the drive means 29A for the cooking apparatus 20A is substantially the same as the operation of the drive means 29 for the cooking apparatus 20 previously described, a further discussion of the operation of the drive means 29A need not be set forth.

It has been found according to the teachings of this invention that the holes 100 or recesses 76 and their associated ramps 77 previously described can be replaced by substantially cylindrical projections or bosses and that the piston means of the drive means can have a simple spring member to provide for movement of the cam in the same manner and for the same reasons previously set forth.

In particular, another cooking apparatus 20B of this invention is generally indicated by the reference numeral 20B in FIGS. 18–27 and parts thereof similar to the parts of the cooking apparatus 20 and 20A previously described are indicated by like reference numerals followed by the reference letter "B".

In fact, the drive means 29B of the cooking apparatus 20B of FIGS. 18–27 is now the preferred embodiment of this invention.

It can be seen that the drive means 29B for the cooking apparatus 20B of this invention is substantially the same as the drive means 29 or 29A previously described except that the flat drive surface 75B of the cam 40B has outwardly directed cylindrical projections or bosses 200 extending outwardly therefrom in the exact same location where the recesses 76 of the cam 40 or the holes 100 of the cam 40A were located, the cam 40B having the cam surface 42B thereof for operating on the cam follower 43B of the latch member 27B for the reasons previously set forth.

However, it can also be seen that the plate 30B of the drive means 29B not only carries the switch means 24B for the purpose previously described but also carries the piston and cylinder means 56 in such a manner that the same is disposed 90° out of phase of the piston and cylinder means 56 and 56A previously described. However, it is to be understood that the piston and cylinder means 56B could be disposed at any one of the 90° positions to operate on the cam 40B in a like manner. In addition, the plate 30B carries an over travel switch means 201 for a purpose hereinafter described.

Figure 21:
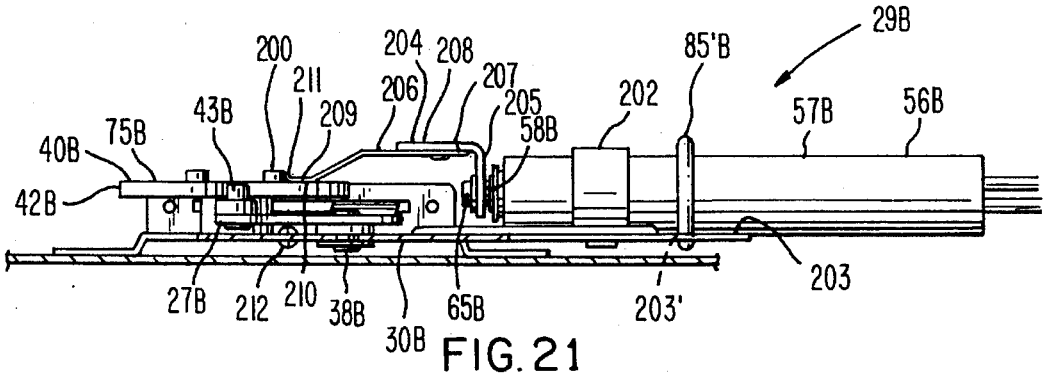
FIG. 21 is a fragmentary cross-sectional view taken on lines 21—21 of FIG. 18.
Figure 22:
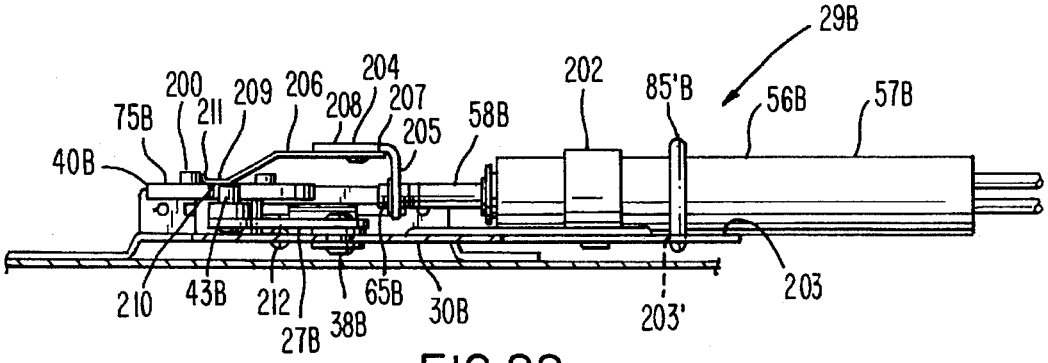
FIG. 22 is a fragmentary cross-sectional view taken on lines 22—22 of FIG. 20.

A strap 202 holds the cylinder 57B of the piston and cylinder means 56B against the surface 203 of the plate 30B while the enlargement 85'B of the cylinder 57B is received in a notch 203' formed through the plate 30B in the manner illustrated in FIG. 21 so that the piston and cylinder means 56B cannot move axially on the plate 30B within the strap 202.

In addition, an L-shaped bracket 204 has one leg 205 fastened to the piston means 58B of the piston and cylinder device 56B in any suitable manner, such as by being threaded on the threaded end 65B of the piston means 58B. A leaf spring member 206 has one end 207 fastened to another leg 208 of the L-shaped member 204 in any suitable manner, such as by riveting, so that the other end 209 of the leaf spring blade or meter 206 extends beyond the leg 208 of the member 204 and is bent in such a manner that a flat section 210 thereof is adapted to engage against the flat surface 75B of the cam 40B with the natural spring force of spring blade 206 and an upwardly turned end 211 of the leaf spring member 206 is adapted to engage against the side of one of the projections or bosses 200 in the manner illustrated in FIGS. 18 and 21 when the piston means 58B is fully retracted into the cylinder 57B by the internal spring means 61B of the piston and cylinder device 56B.

Figure 18:
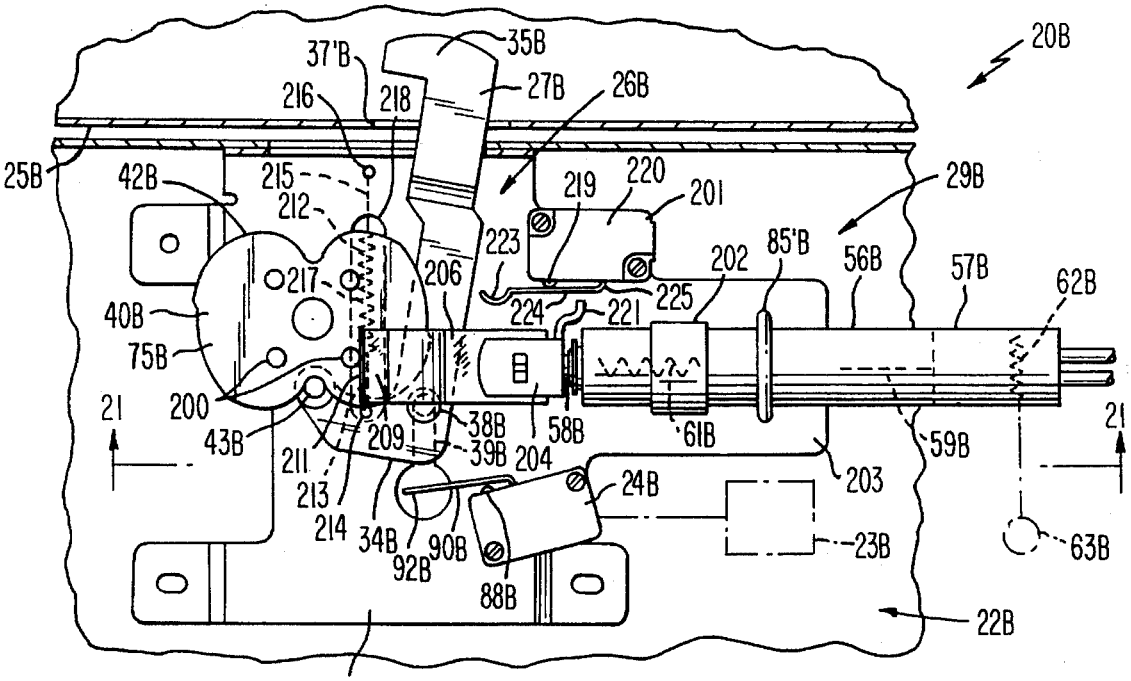
FIG. 18 is a view similar to FIG. 13 and illustrates another cooking apparatus of this invention having another latching construction of this invention, the latch member of the latching construction being in its fully unlatched position.

Thus, it can be seen in FIG. 18 that the turned end 211 of the spring member 206 is disposed against the lower right hand projection 200 of the cam 40B while the cam surface 42B of the cam 40B is acting on the cam follower 43B of the latch member 27B to permit a tension spring 212 to hold the latch member 27B in its door unlocked position, the tension spring 212 functioning in the same manner as the tension springs 47 and 47A previously described but being disposed in another location.

Figure 27:
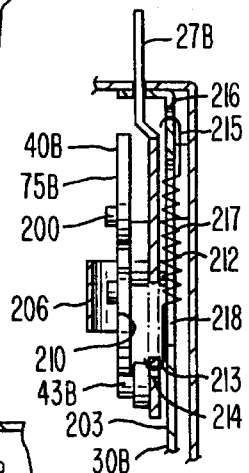
FIG. 27 is a fragmentary cross-sectional view taken on lines 27—27 of FIG. 26.
Figure 26:
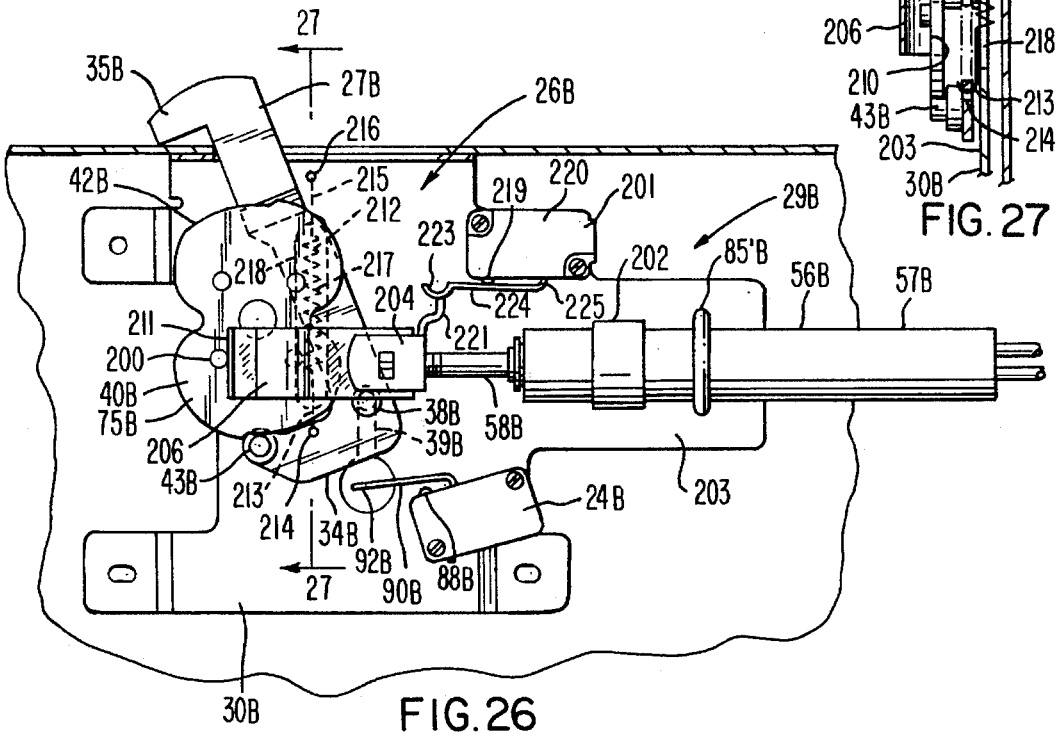
FIG. 26 is a view similar to FIG. 25 and illustrates the latch member having been moved to a third position thereof when the oven door is not in a closed condition thereof as in FIG. 12.

In particular one end 213 of the tension spring 212 is hooked through an opening 214 in the end 34B of the latch member 27B and an opposite end 215 of the tension spring 212 is hooked through an opening 216 in the plate 30B in the manner illustrated in FIG. 27 while the coiled portion 217 of the tension spring 212 is received in an elongated slot 218 formed through the plate 30B in the manner illustrated in FIG. 27 so that the latch member 27B is adapted to move over the tension spring 212 when the latch member 27B moves to its third position as illustrated in FIG. 26 when the oven door 25B is in an open condition thereof and an attempt has been made to move the latch member 27B to its door latching position.

The switch 201 that is carried by the plate 30B has an actuator button 219 which when pushed into the housing means 220 of the switch 201 will actuate the switch 201 and terminate the flow of any electrical current to the actuator means 62B to terminate the operation thereof.

Figure 20:
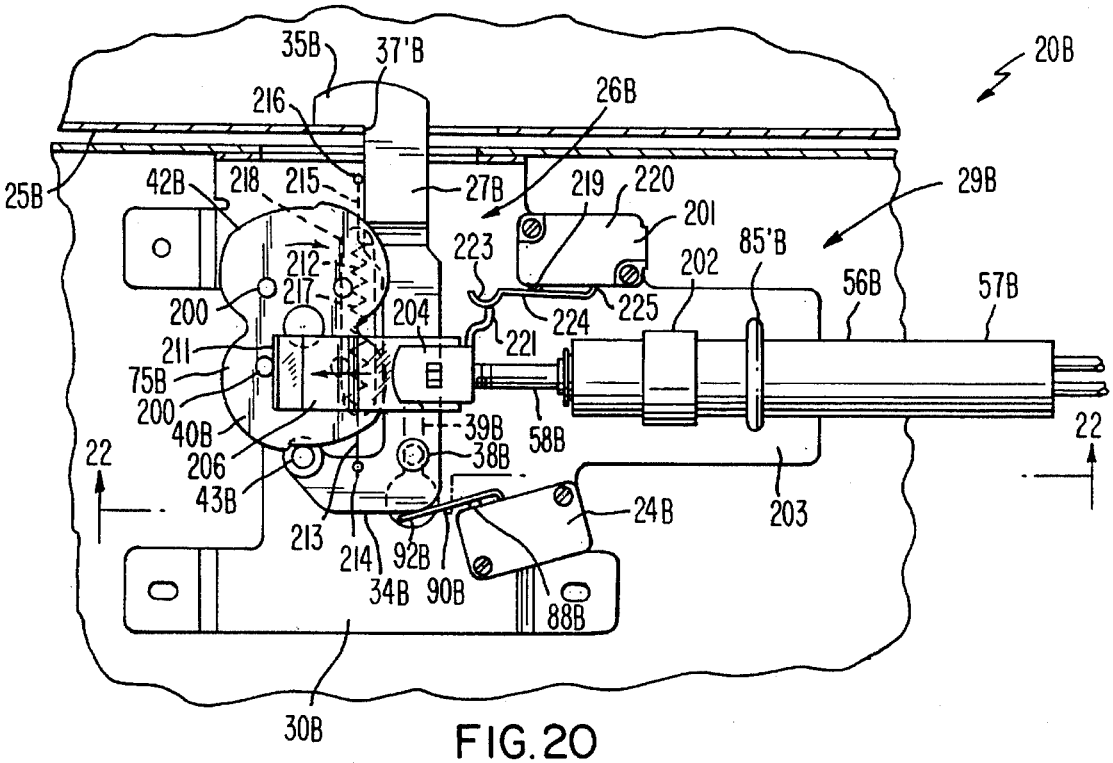
FIG. 20 is a view similar to FIG. 19 and illustrates the latch means in its door locked position and with the piston means in its fully extended condition.

In particular, the L-shaped member 204 of the piston means 58B has a tang 221 which is adapted to engage against a curved end 223 of an arm 224 that is pivotally mounted to a housing means 220 of the switch 201 at another end 225 thereof when the piston means 58B has been fully extended in the manner illustrated in FIG. 20 whereby the spring means 61B of the drive means 29B can thereafter return the piston means 58B to its fully retracted position as illustrated in FIG. 18.

Therefore, it can be seen that it is a relatively simple method of this invention to make the latching construction 26B of this invention to operate in the cooking apparatus 20B in a manner now to be described.

Normally, the latch construction 26B is disposed in the condition illustrated in FIGS. 18 and 21 where the latch member 27B is its nonlatching position with the piston means 58B being as in its fully retracted condition so that the bent end 211 of the spring member 206 is to the right of the lower right hand projection 200 of the cam member 40B with the cam member 40B being in the position illustrated in FIG. 18.

Figure 19:
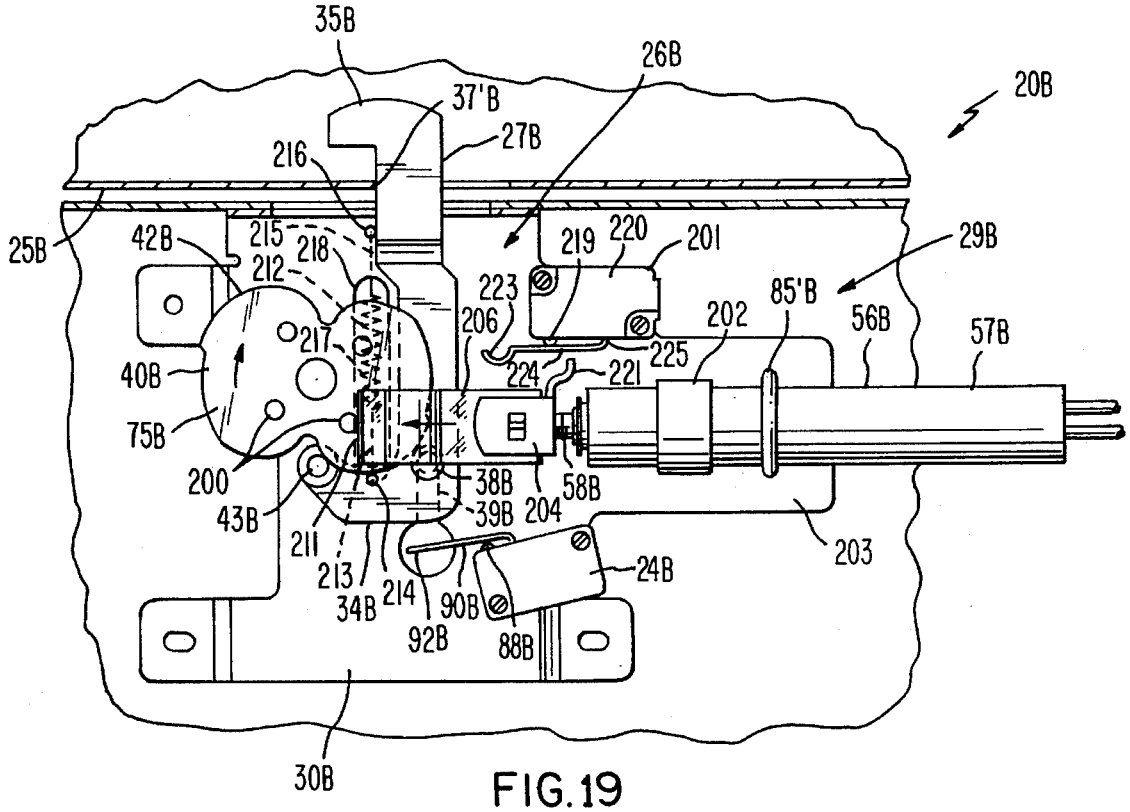
FIG. 19 is a view similar to FIG. 18 and illustrates the latch member having been moved against the oven door as in FIG. 5.
Figure 23:
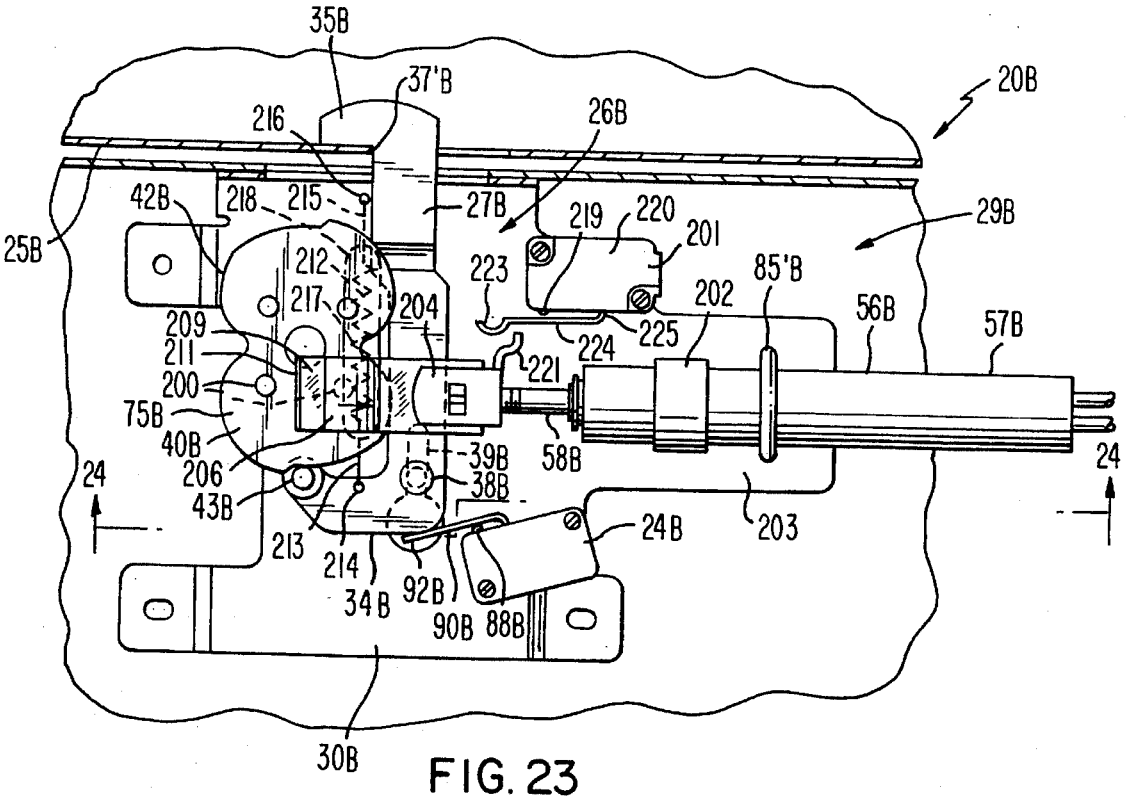
FIG. 23 is a view similar to FIG. 20 and illustrates the piston means as it is being moved toward its retracted position.

When it is desired to latch the oven door 25B in its closed condition as illustrated in FIG. 20, the operator through a suitable switch (not shown) causes the electrical power source 63B to be interconnected to the actuator means 62B of the drive means 29B to cause the piston means 58B to be extended outwardly from the cylinder member 57B in opposition to the force of the spring 61B as illustrated in FIG. 18, such outward movement of the piston means 58B causing the drive cam 40B to rotate in a clockwise direction as illustrated in FIG. 19 as the turned end 211 of the spring member 206 is pushing against the side of the projection 200 to so rotate the cam member 40B. Such clockwise rotation of the drive cam 40B causes the cam surface 42B thereof to act on the cam follower 43B of the latch member 27B and pivot the latch member 27B in a counterclockwise direction on the pivot pin 38B thereof until the latch member 27B engages against the edge 37'B of the oven door 25B as illustrated in FIG. 19 so that the latch member 27B can no longer be moved in a clockwise direction by the outwardly extending piston means 58B. However, further movement of the piston means 58B in an extending direction thereof as illustrated in FIG. 20 continues to cause the drive cam 40B to rotate in a clockwise direction as illustrated in FIG. 20 whereby the pivot pin 38B of the latch member 27B slides downwardly in the slot 39B as illustrated in FIG. 20 until the hook 35B of the latch member 27B engages against the side 25'B of the oven door 25B, pulls the oven door 25B tightly closed and holds the same in its closed condition as illustrated in FIGS. 20 and 23. Such movement of the latch member 27 to its locking condition as illustrated in FIGS. 20 and 23 causes the end 34B of the latch member 27B to operate on the end 92B of the arm 90B of the switch 24B to move the actuator button 88B to its in actuated condition whereby the switch means 24 now permits the heating means 23B of the cooking apparatus 20B to heat clean the oven 22B.

Figure 24:
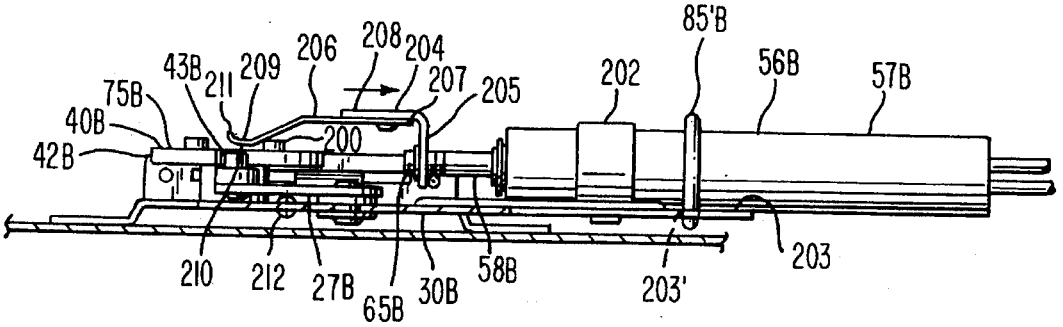
FIG. 24 is a fragmentary cross-sectional view taken on lines 24—24 of FIG. 23.
Figure 25:
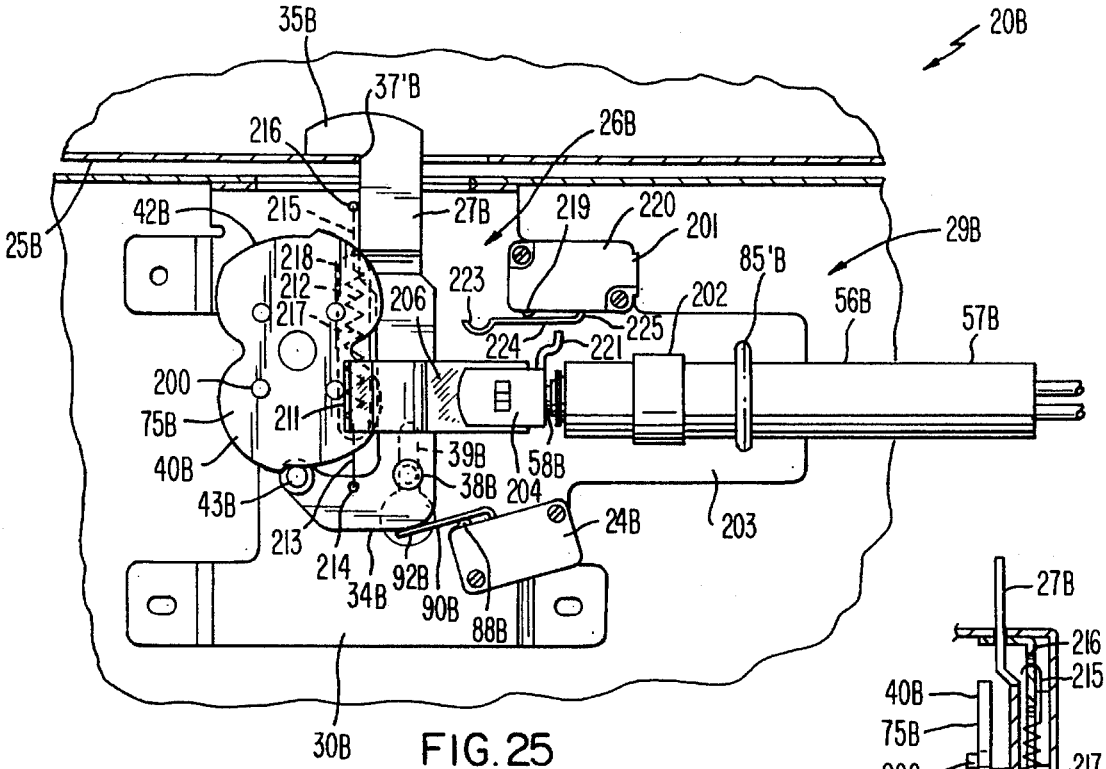
FIG. 25 is a view similar to FIG. 23 and illustrates the piston means in its fully retracted position with the latch member in its door locked position.

However, after the piston means 58B of the drive means has moved to its extended condition as illustrated in FIG. 20 and the tang 221 thereof has actuated the button 219 of the switch 201, the switch 201 terminates the flow of electrical current to the actuator means 62B of the drive means 29B so that the internal spring means 61B of the drive means 29B will now move the piston means 58B from its fully extended position back toward its fully retracted position and such movement of the piston means 58B causes the spring member 206 to cam over the projection 200 of the cam 40B which is now disposed in the lower right hand position thereof as illustrated in FIG. 24 so that the bent end 211 of the spring member 206 will be positioned to the right of that lower right hand projection 200 when the piston means 58B is in its fully retracted condition as illustrated in FIG. 25, the natural resiliency of the spring member 206 causing the portion 209 of the spring member 206 to again move against the flat surface 75B of the cam 40B after the end 211 passes to the right of that right hand projection 200 as illustrated in FIG. 25.

In this manner, the actuator 62B of the drive means 29B need not be maintained in an actuated condition thereof during the entire time that the oven chamber 22B is being heat cleaned by the heating means 23B.

After the oven chamber 22B has been heat cleaned and the heating means 23B has been turned off by the control means (not shown) of the cooking apparatus 20B so that the temperature of the oven 22B eventually falls below a safe temperature, such as below approximately 600 degrees F., the operator of the control means of the cooking apparatus 20B causes the power source 63B to be interconnected to the actuator 62B to again cause the piston means 58B to be outwardly extended from its retracted condition to rotate the drive cam 40 in a clockwise direction and through the cam surface 42B thereof to permit the latch member 27B to move to its unlatching position by the force of the tension spring 212 in the manner previously described. Once the door 25B has been unlocked, the flow of the electrical current from the source 63B to the actuator 62B of the drive means 29B is again terminated by the switch means 201 so that the internal spring means 61B of the drive means 29B now causes the piston means 58B to be retracted and in this position of drive means 29B, the spring member 206 now has the bent end 211 thereof positioned to the right of the lower right hand projection 200 of the cam 40B in the manner illustrated in FIG. 18 so as to be again in the proper position to thereafter perform a latching operation in the manner previously described when needed.

However, should the oven door 25B not be in a closed condition when the drive means 29B is actuated to begin a door locking operation, such outward movement of the piston means 58B causes the drive cam 40B to rotate in a clockwise direction and cause the latch member 27B to pivot in a counterclockwise direction but since the latch member 27B does not hit the edge 37'B of the oven door 25B, the latch member 27B continues to pivot in the manner illustrated in FIG. 26 and not have the end 34B thereof engage the arm 90B of the switch means 24B to actuate the actuator button 88B thereof. Thus, once the actuator means 62B is disconnected from the power source 63B by the switch 201 being actuated by the tang 221 of the piston means 58B, the internal spring means 61B of the drive means 29B will retract the piston means 58B from the position illustrated in FIG. 26 so that the bent end 211 of the spring member 206 will now be disposed to the right of the lower right hand projection 200 of the cam 40B. In this manner, a subsequent actuation of the actuator 62B to extend the piston means 58B will cause the drive cam 40B to rotate in a clockwise direction and thereby permit the latch member 27B to likewise rotate in a clockwise direction and return to its non-latching position as illustrated in FIG. 18.

Thus, it can be seen that in all the embodiments of this invention the unique cam means 40, 40A and 40B thereof each always rotates in only one direction of rotation thereof each time the respective piston means 58, 58A or 58B is extended and will not be rotated when that respective piston means 58, 58A or 58B is retracted so that the driving mechanism of this invention is believed to be simpler in the construction thereof over the cam arrangement disclosed in the aforementioned copending patent application Ser. No. 250,006 filed May 27, 1994.

Therefore, it can be seen that this invention not only provides a new cooking apparatus and a new method of making such a cooking apparatus, but also this invention provides a new latching construction for a cooking apparatus and new method of making such a new latching construction.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a cooking apparatus comprising a frame means, a cooking chamber means carried by said frame means, heating means carried by said frame means and being adapted to be actuated to heat clean said chamber means, switch means for permitting said heating means to heat clean said chamber means only when said switch means is actuated, a movable door means carried by said frame means for opening and closing said cooking chamber means, a movable latch member carried by said frame means and being movable between a non-latching position thereof that permits said door means to be opened and closed and a latching position thereof that locks said door means in its closed position and actuates said switch means if said door means is in its closed position at the time said latch member is moved to said latching position thereof, and drive means carried by said frame means and having moving means operatively interconnected to said latch member to move said latch member between said positions thereof only when said moving means of said drive means moves from a first position thereof to a second position thereof, said drive means comprising a cylinder means having opposite ends and a movable piston means extending from one of said opposite ends and comprising said moving means operatively interconnected to said latch member, said drive means having actuating means to extend said piston means so as to be adapted to move said latch member from its said non-latching position thereof to its said latching position thereof when said actuating means is first actuated for a door locking operation thereof, said drive means comprising a cam means movably mounted to said frame means and having interconnecting means operatively interconnected to said piston means and to said latch member in a manner to permit said piston means to be retracted after said latch member has been moved to said latching position thereof by said first actuation of said actuating means while maintaining said latch member in its said latching position until said actuating means is again actuated, the improvement wherein said cam means comprises a cam rotatably mounted to said frame means and being operatively interconnected to said piston means by said interconnecting means thereof so as to be rotated in only one rotatable direction thereby.

2. A cooking apparatus as set forth in claim 1 wherein said interconnecting means of said cam that is operatively interconnected to said latch member comprises a cam surface means of said cam.

3. A cooking apparatus as set forth in claim 2 wherein said cam has an outer peripheral surface that comprises said cam surface means thereof, said latch member having a cam follower means attached thereto and being disposed in engagement with said cam surface means.

4. A cooking apparatus as set forth in claim 1 wherein said cam has a surface means provided with structure disposed in a circular array about the axis of rotation thereof, said structure comprising said interconnecting means of said cam means that is operatively interconnected to said piston means.

5. A cooking apparatus as set forth in claim 4 wherein said structure of said cam comprises a plurality of spaced apart projections extending outwardly from said cam in said circular array, said piston means having a spring member for engaging one of said projections and pushing the same so as to rotate said cam in said one direction thereof a certain distance each time said actuating means is actuated to extend said piston means from a retracted position thereof.

6. A cooking apparatus as set forth in claim 1 wherein said cam means of said drive means is adapted to cause said latch member to move from said latching position thereof to said non-latching position thereof by extending said piston means when said actuating means is said again actuated to again rotate said cam in said one direction thereof.

7. A cooking apparatus as set forth in claim 1 wherein said actuating means of said drive means is electrically operated.

8. A cooking apparatus as set forth in claim 7 wherein said actuating means of said drive means comprises an electro-thermal means.

9. A cooking apparatus as set forth in claim 1 wherein said latch member is movable from said non-latching position to a third position thereof by said drive means when said drive means tends to move said latch member from said non-latching position thereof to said latching position thereof when said door means is not in a closed condition thereof and said moving means of said drive means moves from said first position thereof to said second position thereof, said latch member being adapted to actuate said switch means only when said latch member is in said latching position thereof.

10. In a latching construction for a cooking apparatus having a cooking chamber means and a movable door means for opening and closing said cooking chamber means, said latch construction comprising a frame means, a movable latch member carried by said frame means and being movable between a non-latching position thereof that would permit said door means to be opened and closed and a latching position thereof that would lock said door means in its closed position if said door means is in its closed position at the time said latch member is moved to said latching position thereof, and drive means carried by said frame means and having moving means operatively interconnected to said latch member to move said latch member between said positions thereof only when said moving means of said drive means moves from a first position thereof to a second position thereof, said drive means comprising a cylinder means having opposite ends and a movable piston means extending from one of said opposite ends and comprising said moving means operatively interconnected to said latch member, said drive means having actuating means to extend said piston means so as to be adapted to move said latch member from its said non-latching position thereof to its said latching position thereof when said actuating means is first actuated for a door locking operation thereof, said drive means comprising a cam means movably mounted to said frame means and having interconnecting means operatively interconnected to said piston means and to said latch member in a manner to permit said piston means to be retracted after said latch member has been moved to said latching position thereof by said first actuation of said actuating means while maintaining said latch member in its said latching position until said actuating means is again actuated, the improvement wherein said cam means comprises a cam rotatably mounted to said frame means and being operatively interconnected to said piston means by said interconnecting means thereof so as to be rotated in only one rotatable direction thereby.

11. A latching construction as set forth in claim 10 wherein said interconnecting means of said cam that is operatively interconnected to said latch member comprises a cam surface means of said cam.

12. A latching construction as set forth in claim 11 wherein said cam has an outer peripheral surface that comprises said cam surface means thereof, said latch member having a cam follower means attached thereto and being disposed in engagement with said cam surface means.

13. A latching construction as set forth in claim 10 wherein said cam has a surface means provided with structure disposed in a circular array about the axis of rotation thereof, said structure comprising said interconnecting means of said cam means that is operatively interconnected to said piston means.

14. A latching construction as set forth in claim 13 wherein said structure of said cam comprises a plurality of spaced apart projections extending outwardly from said cam in said circular array, said piston means having a spring meter for engaging one of said projections and pushing the same so as to rotate said cam in said one direction thereof a certain distance each time said actuating means is actuated to extend said piston means from a retracted position thereof.

15. A latching construction as set forth in claim 10 wherein said cam means of said drive means is adapted to cause said latch member to move from said latching position thereof to said non-latching position thereof by extending said piston means when said actuating means is said again actuated to again rotate said cam in said one direction thereof.

16. A latching construction as set forth in claim 10 wherein said actuating means of said drive means is electrically operated.

17. A latching construction as set forth in claim 16 wherein said actuating means of said drive means comprises an electro-thermal means.

18. A latching construction as set forth in claim 10 wherein said latch member is movable from said non-latching position to a third position thereof by said drive means when said drive means tends to move said latch member from said non-latching position thereof to said latching position thereof when said door means is not in a closed condition thereof and said moving means of said drive means moves from said first position thereof to said second position thereof.

19. In a method of making a cooking apparatus comprising a frame means, a cooking chamber means carried by said frame means, heating means carried by said frame means and being adapted to be actuated to heat clean said chamber means, switch means for permitting said heating means to heat clean said chamber means only when said switch means is actuated, a movable door means carried by said frame means for opening and closing said cooking chamber means, a movable latch member carried by said frame means and being movable between a non-latching position thereof that permits said door means to be opened and closed and a latching position thereof that locks said door means in its closed position and actuates said switch means if said door means is in its closed position at the time said latch member is moved to said latching position thereof, and drive means carried by said frame means and having moving means operatively interconnected to said latch member to move said latch member between said positions thereof only when said moving means of said drive means moves from a first position thereof to a second position thereof, said drive means comprising a cylinder means having opposite ends and a movable piston means extending from one of said opposite ends and comprising said moving means operatively interconnected to said latch member, said drive means having actuating means to extend said piston means so as to be adapted to move said latch member from its said non-latching position thereof to its said latching position thereof when said actuating means is first actuated for a door locking operation thereof, said drive means comprising a cam means movably mounted to said frame means and having interconnecting means operatively interconnected to said piston means and to said latch member in a manner to permit said piston means to be retracted after said latch member has been moved to said latching position thereof by said first actuation of said actuating means while maintaining said latch member in its said latching position until said actuating means is again actuated, the improvement comprising the step of forming said cam means to comprise a cam rotatably mounted to said frame means and being operatively interconnected to said piston means by said interconnecting means thereof so as to be rotated in only one rotatable direction thereby.

20. In a method of making a latching construction for a cooking apparatus having a cooking chamber means and a movable door means for opening and closing said cooking chamber means, said latch construction comprising a frame means, a movable latch member carried by said frame means and being movable between a non-latching position thereof that would permit said door means to be opened and closed and a latching position thereof that would lock said door means in its closed position if said door means is in its closed position at the time said latch member is moved to said latching position thereof, and drive means carried by said frame means and having moving means operatively interconnected to said latch member to move said latch member between said positions thereof only when said moving means of said drive means moves from a first position thereof to a second position thereof, said drive means comprising a cylinder means having opposite ends and a movable piston means extending from one of said opposite ends and comprising said moving means operatively interconnected to said latch member, said drive means having actuating means to extend said piston means so as to be adapted to move said latch member from its said non-latching position thereof to its said latching position thereof when said actuating means is first actuated for a door locking operation thereof, said drive means comprising a cam means movably mounted to said frame means and having interconnecting means operatively interconnected to said piston means and to said latch member in a manner to permit said piston means to be retracted after said latch member has been moved to said latching position thereof by said first actuation of said actuating means while maintaining said latch member in its said latching position until said actuating means is again actuated, the improvement comprising the step of forming said cam means to comprise a cam rotatably mounted to said frame means and being operatively interconnected to said piston means by said interconnecting means thereof so as to be rotated in only one rotatable direction thereby.

* * * * *